US005135219A

United States Patent [19]

McKeon et al.

[11] Patent Number: 5,135,219

[45] Date of Patent: Aug. 4, 1992

[54] BATTER ACTUATED BASEBALL BATTING PRACTICE DEVICE

[76] Inventors: Tim O. McKeon; Douglas R. Russell, both of P.O. Box 6504, Louisville, Ky. 40206

[21] Appl. No.: 608,554

[22] Filed: Nov. 2, 1990

[51] Int. Cl.[5] ..... A63B 69/40

[52] U.S. Cl. ..... 273/26 E; 273/29 A; 273/200 R; 273/58 C

[58] Field of Search ..... 273/26 R, 29 A, 26 E, 273/58 C, 29 R, 200 R, 411, 197 A, 200 B, 26 GA, 184 B, 185 C, 185 D, 196, 197 R, 198, 208, 319, 321

[56] References Cited

U.S. PATENT DOCUMENTS

| | | | |
|---|---|---|---|
| 1,597,307 | 8/1926 | Bettini | 273/185 C |
| 1,826,221 | 10/1931 | Pearson | 273/58 C |
| 2,081,059 | 5/1937 | Mitchell | 273/58 C |
| 3,262,703 | 7/1966 | Hodlick | 273/58 C |
| 3,425,700 | 2/1969 | Edwards | 273/58 C |
| 3,470,845 | 10/1969 | Mignano | 273/58 C |
| 3,637,209 | 1/1972 | Raut | 273/26 E |
| 3,731,925 | 5/1973 | Caldwell | 273/58 C |
| 3,934,873 | 1/1976 | Griffin | 273/26 E |
| 4,186,921 | 2/1980 | Fox | 273/26 E |
| 4,322,075 | 3/1982 | Hynes | 273/26 E |
| 4,735,413 | 4/1988 | Yamanouchi et al. | 273/58 C |
| 4,898,385 | 2/1990 | Love | 273/26 E |

FOREIGN PATENT DOCUMENTS

| | | | |
|---|---|---|---|
| 447316 | 5/1936 | United Kingdom | 273/197 R |

*Primary Examiner*—Theatrice Brown

[57] ABSTRACT

A baseball batting practice device in which a diametral bore in a baseball is snugly lined by a metal tube, the ends of which are flared to secure the cover of the baseball adjacent the ends of the ball bore. A suspending line secured adjacent its upper end to an overhead support extends successively through a sleeve and the tube in the ball and has ball restraining means below the ball which rests thereon. A swing-and-lift line connects the suspending line above the sleeve to an upright support below and laterally of the suspended ball. When a batter bats the ball the suspending and swing-and-lift lines are wound progressively about the upright support toward the ball until the ball strikes and rebounds from the upright support and returns to the batting zone to be batted again.

11 Claims, 2 Drawing Sheets

BATTER ACTUATED BASEBALL BATTING PRACTICE DEVICE

This invention relates to a baseball batting practice device operated by the practicing batter. More particularly, this invention relates to a practice device having a ball on a suspending line and on a ball swing-and-lift restraining line. The batter places the ball in motion by hitting it with a bat, either from an initial stationary or a subsequent moving condition, and the cooperation of the lines with a support cause the ball to strike the support and rebound in reverse direction and return through the batting zone one or more times to afford the batter opportunities to initiate another batting cycle by hitting the ball in a continuing practice session.

BACKGROUND OF THE INVENTION

Baseball players develop the necessary skills through practice, either by playing the game or by training exercises under the guidance of a coach. Batting is one of the skills that usually require a great deal of practice, but when young players want to practice, they are not always able to find players or coaches who have the inclination to or can take the time to pitch balls for batting practice, field balls the practicing batter hits and catch balls the batter misses.

There have been efforts to deal with the problem of nonavailability of players and coaches at the times when the batter is ready to practice. Some of these, for example pitching machines with ball catching netting, are beyond the means of most players. The young player usually relies upon family members, neighbors and others to participate in the practice sessions, but such help is not always conveniently available when a player would like to practice batting.

U.S. Pat. No. 3,637,209 discloses a ball tethered by a string to a handle by which a coach may swing the ball past the practicing batter, who tries to bat the ball. While such a device substantially eliminates the need to field the ball when hit by the batter and to catch it when missed by the batter, it still requires a coach or operator to swing the ball so the batter can practice batting, and its use involves some risk in that the batter may hit the ball in a way that it does not just reverse direction in traveling its circular path, but instead can at times travel the short path directly to the coach so fast that the coach, unable to duck the ball in time, is struck by it. While the use of a rubber ball strong enough to be hit by a bat, suggested by said patent, may tend to reduce the risk of injury to the operator or coach, such a ball does not have the physical qualities of a regulation baseball and thus, when hit with a bat, does not give the feel due to the weight and the resiliency of a regulation baseball which the batter's hands sense as a result of impact of the bat with a regulation baseball.

An object of this invention is to provide a baseball batting practice device in which the ball the batter hits with his bat has substantially the characteristics of a regulation baseball.

BRIEF STATEMENT OF THE INVENTION

Briefly, this invention provides a baseball batting practice device which includes a regulation baseball having a diametral opening through it snugly lined by a metal tube. The end portions of the tube are flared outwardly and curved so the edges of the tube flanges engage the outer surface of the ball cover to securely anchor the hide cover of the ball adjacent the ends of the opening. The flared end portions of the metal tube lie substantially within the generally spherical shape of the ball. The metal tube has a weight substantially equal to the weight of the material removed incident to forming the opening in the ball, and has a symmetrical configuration substantially maintaining the balance of the ball as well. A ball suspending line is secured adjacent its first or upper end to an overhead support, such as the horizontal arm of a basketball backboard support or a tree limb. The suspending line extends downwardly through a rope protecting sleeve and the metal tube in the ball to a ball retaining knot in the suspending line adjacent its second or lower end. The flared lower end of the metal tube seats on the retaining knot to retain the ball on the line. A swing-and-lift restraining line is secured adjacent its first end to an upright support, such as the upright support of a basketball backboard support or a tree trunk or the like, at a level in or below the strike zone of the batter. The second end of the swing-and-lift restraining line is secured to the ball suspending line at a point above, but adjacent to, the upper end of the rope protecting sleeve. The portion of the suspending line below the juncture with the swing-and-lift restraining line is thus viewable as a branch line restrained at its upper end, weighted by the ball adjacent its lower end and of a length which provides a distance between the ball and the juncture of the lines which is greater than the length of the rigid tube so as to permit bending of the line between the ball and tube, or the tube and the juncture of the lines, or both when the flared end of the metal tube in the ball seats on the knot. The rigid tube precludes winding of the branch line around the suspending and swing-and-lift lines, and also tends to cause the ball to travel a path outwardly of the suspending and swing-and-lift lines so as to minimize the likelihood of the bat engaging the suspending and swing-and-lift lines when the batter bats the ball. When the batter bats the ball, it carries the suspending and swing-and-lift lines with it to progressively wrap the lines from adjacent their first ends progressively around respective portions of the support until the rigid tube and ball move into engagement with the support and the ball rebounds to unwind the lines from the support until the ball swings through the batting zone one or more times in a direction suitable for the batter to again strike it with a bat to impel the ball in the windup direction until it again reverses so that the batter may repeatedly bat the ball without need of a pitcher, catcher or someone to field the ball hit by the batter in practice.

The above and other objects of the invention will be apparent to those having ordinary skill in the art to which this invention pertains from the following detailed description and the drawings in which like reference characters indicate like parts.

DESCRIPTION OF PRESENTLY PREFERRED EMBODIMENT

Figure 1:
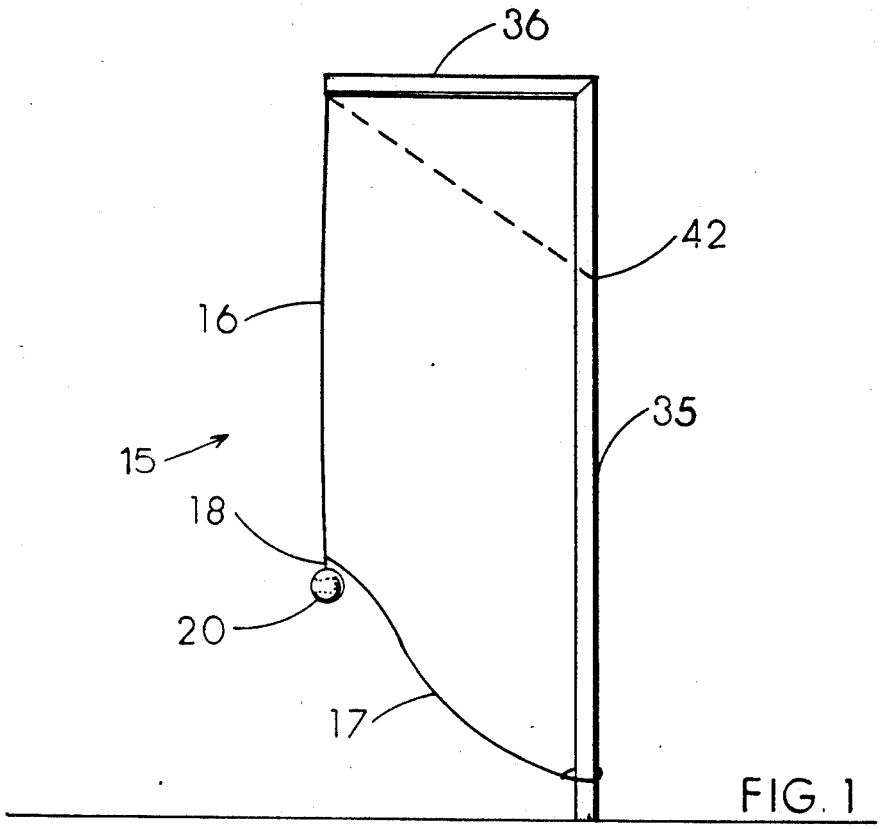
FIG. 1 is a view in vertical elevation showing a support having an upright and upper horizontal members in cooperate relation in an illustrative embodiment of this invention.
Figure 2:
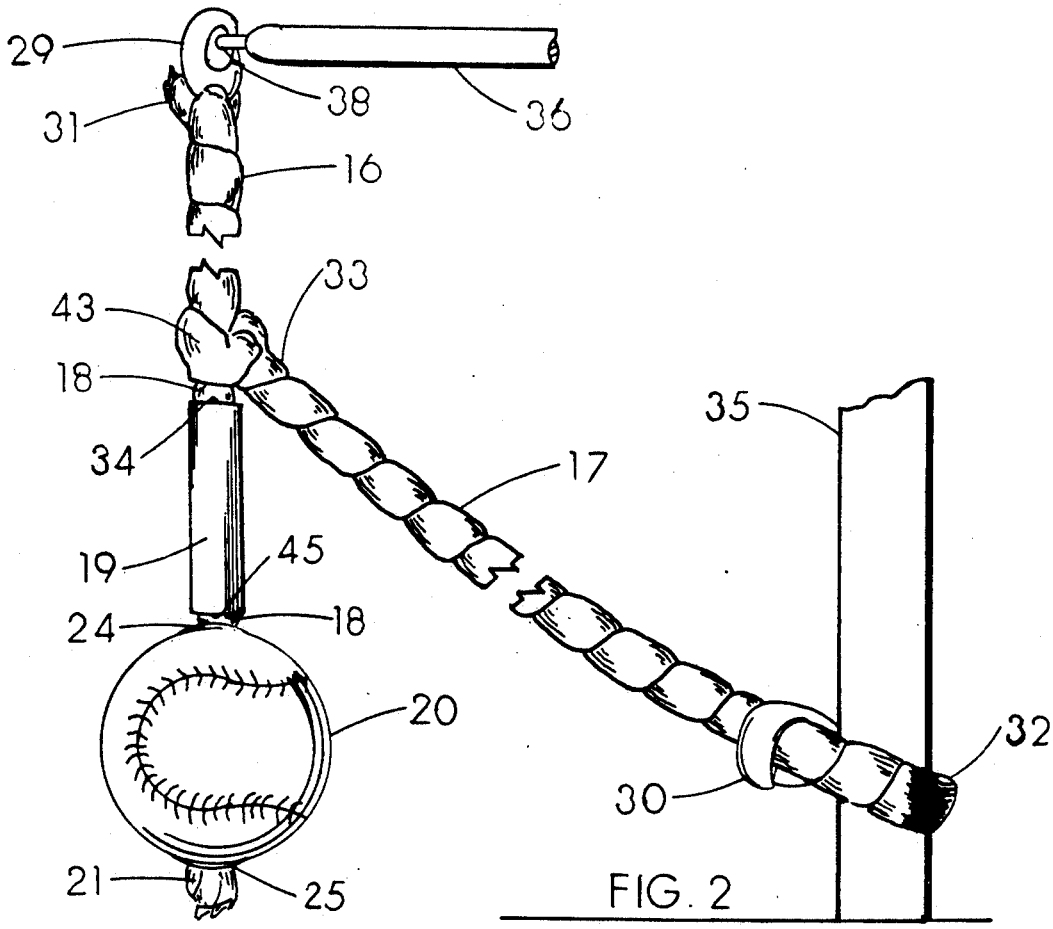
FIG. 2 is a fragmentary view of the embodiment shown in FIG. 1, portions thereof being broken away and details enlarged to better illustrate features of the invention.

In FIGS. 1 and 2 a baseball batting practice device 15 constructed in accordance with an embodiment of this invention is shown. The practice device 15 includes an upper or suspending line 16, a lower or swing-and-lift restraining line 17, a branch line 18, a branch line protecting sleeve 19 and a modified regulation baseball 20. The protecting sleeve 19 and baseball 20 are retained on branch line 18 by knot 21.

Figure 3:
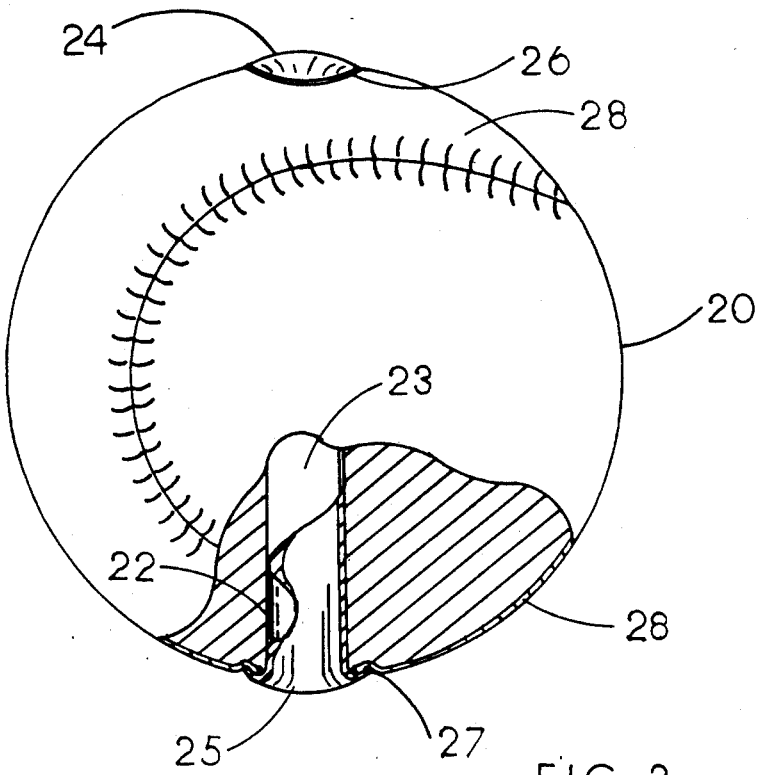
FIG. 3 is a view of a baseball modified to form part of the preferred embodiment of the invention.

As shown more clearly in FIG. 3, baseball 20 has a diametral opening 22, snugly lined by metal tube 23. The tube 23 has flared ends 24,25, the respective edges 26,27 of which are turned back to grip the hide cover 28 of the ball annularly of the opening in the ball to secure the hide in place adjacent the ends of the opening to maintain the integrity of the ball 20. The tube 23 is made of metal and has walls of such thickness that the tube has a weight substantially equal to the weight of the material removed incident to formation of the opening 22 which the tube 23 lines. The weight of the tube 23 is so distributed in relation to the center of balance of the ball that the balance of the baseball 20 is maintained.

To support the ball 20 and control its movements, the ball is suspended from suitable supports by a bridle-like structure which may be fabricated in the preferred form from two pieces of line 16,17 which are of approximately equal length and each of which may, but need not be, of the order of ten (10) feet in length. While various types of line may be used, we find hollow braided polypropylene rope of ¼" size works quite satisfactorily and has certain advantages. The upper or suspending line 16 is preferably provided with a snap hook 29 adjacent its end 31 remote from the ball 20 so that that end of the line may be attached to an overhead support. The second line is a lower or swing-and-lift restraining line 17 which may be fabricated from hollow braided polypropylene rope of like size as that of which the upper or suspending line is fabricated. The end 32 of the lower or swing-and-lift restraining line 17 may also be provided with a snap hook 30 adjacent its end 32 remote from suspending line 16 so that the snap hook 30 may be engaged to suitably anchor the end 32 of line 17 to, in cooperation with the suspending line 16, afford restraining control over the ball 20. The second end 33 of the swing-and-lift restraining line 17 is secured in unitary relation to the suspension line 16 an appropriate distance above the lower end of the latter. The securing of the swing-and-lift line 17 to the suspension line 16 is preferably accomplished by splicing the swing-and-lift line 17 to the suspension line in splice 43. The splicing is facilitated by use of the hollow braided polypropylene rope mentioned above as the hollow braided polypropylene rope in the splice vicinity can be manipulated into a relaxed somewhat shortened and expanded open braided condition to facilitate the splicing of the end portion of the swing-and-lift line 17 into splice forming relation with the suspension line 16, and then when tensioning forces tending to elongate the suspension line 16 and swing-and-lift line 17 are applied to the lines, they produce a contracting action moving the fibers of the lines into more snug close embrace to form a secure non-slipping splice. The portion of the suspension line 16 below the splice 43 may be referred to as a branch line 18.

Branch line 18 extends from adjacent splice 43 downwardly as shown in FIG. 2 and extends successively through protective sleeve 19 and metal tube 23 in ball 20 to a retaining knot 21 adjacent its lower end. As shown in FIG. 2, flared end 25 of tube 23 rests upon knot 21 under force of gravity. The portion of branch line 18 extending above ball 20 to splice 43 is longer than protective sleeve 19 which fits loosely on its so that the sleeve may slide toward or away from splice 43 as a result of forces applied to the sleeve by ball 20 incident to movements of the ball relative to the sleeve. The sleeve is preferably made of a material, such as nylon, which has high resistance to damage by contact of the batter-swung-bat with the sleeve. The tubular sleeve has its ends 34,45 rounded in a fashion that they cooperate with branch line 18 in a way as to avoid any substantial damage to the line incident to use of the device. For example, if the branch line is swung out of alignment with the suspending portion 16 of that line upon occurrence of flexing in the branch line in the vicinity of splice 43, the rounded end surface 34 of sleeve 19 adjacent the splice 43 affords a smooth surface which slides readily in relation to swing-and-lift line 17, splice 43 and suspending line 16, as well as branch line 18. The cooperation of the upper end portion of tube 19 with line portions 16, 17 and 18 incident to flexure in the vicinity of splice 43 may result in movement of sleeve 19 downwardly toward or into engagement with ball 20, and, dependent upon the position into which sleeve 19 moves relative to ball 20, there may be additional flexure of the branch line in the vicinity of the upper flange 24 of tube 22 at the top of the ball 20 and the adjacent rounded end surface 45 of sleeve 19. The branch line 18 is of a length ample to accommodate simultaneous maximum bends in line 18 adjacent both ends 34,45 of sleeve 19.

Figure 4:
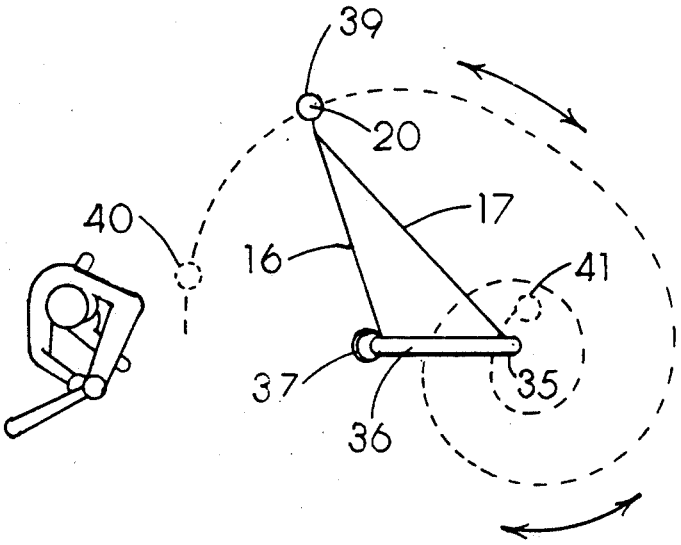
FIG. 4 is a top plan view of a batter using the practice device and illustrating the path of the ball.

The assembly of suspending line 16, swing-and-lift line 17, branch line 18, sleeve 19 and ball 20 is mounted in association with a suitable support for use in practicing batting. As noted earlier, the support required will provide an overhead support for the upper end of suspending line 16 and a second support at or below the strike zone related to the practicing batter to which end 32 of the swing-and-lift line 17 may be secured. The support which we have found preferable is a support in the nature of a basketball backboard support having a vertical pole-like element 35 horizontally from the upper end of which an arm 36 extends. The horizontal arm 36 may have an enlarged free end 37 as shown in FIG. 4, or may have a metal eye-like ring 38 adjacent its free end as shown in FIG. 2. If the arm 36 has an enlarged free end 37, the suspending line 16 may be wrapped one or more times around the horizontal arm 36 and snap hook 29 engaged about the portion of the line extending downwardly from the support toward the ball. On the other hand, snap hook engageable means such as an eyelet or ring end 38 may be provided so the snap hook 29 may be simply engaged with the ring 38. We have found that the enlarged arm end 37 type arrangement more readily permits adjustment of the height of the ball in its suspended at-rest position as shown in FIG. 1 in that making one or more additional turns of the suspending line 16 about horizontal arm 36 effects shortening of the effective length of the suspension line 16, and similarly, unwinding of one or more turns will effect lengthening of the line 16 suspending the ball 20. The swing-and-lift line 17 may similarly be secured to the upright pole 35 at or below the strike zone relative to the practicing batter. We prefer that end 32 of swing-and-lift line 17 is secured substantially below the strike zone and adjacent the surface upon which the batter stands as shown in FIG. 1. The effective length of swing-and-lift line 17 is adjusted so that it is on the order of the proportional length shown in FIG. 1, the adjustment being readily effected by securing end 32 by wrapping the line around the base of the pole and then engaging snap hook 30 on the line so as to form a loop about the pole. If the loop formed by engaging the snap hook 30 on the line section 17 is a single loop and somewhat larger than the circumference of the pole, the end 32 of the swing-and-lift line may, incident to usage of the practice device by a batter, result in the loop moving upward and downward along the pole as a result of forces of gravity and directed tension forces developed incident to batting of the ball by the batter. If additional turns of the rope about the pole are taken, such additional turns tend to substantially reduce the tendency of the end of line 17 remote from the branch line 18 to move up and down the pole incident to use of the device by a practicing batter.

When the device is associated with a support as shown in FIG. 1 and the batter hits the ball with a bat, the ball tends to follow a path determined by the restraining effect of line 16 and 17 which, as the ball travels, are wound about the upright pole 35 as the ball in a substantially spiral line of flight is drawn progressively closer to the pole as the swinging portions of the ropes are progressively shortened incident to their winding about the pole 35 until the splice 43 is wrapped against the pole. At the point where splice 43 is wrapped against the pole, the portion of suspending line 16 above and contiguous with the splice and the portion of swing-and-lift line 17 below and contiguous with the splice 43 are both wound about the pole 35, with the result that the branch line remains in motion. The centrifugal forces draw the ball 20 into firm seated relation to the knot 21 and the sleeve 19 in firm engaging relation with the ball with the result that the branch line flexes primarily in the vicinity of the splice as the sleeve is drawn against the surface of the pole and then also in the inter-ball-sleeve vicinity until the ball impacts the pole and rebounds in a reverse direction of flight along a path spiraling outwardly from the pole as the sleeve 19, suspending line 16 and swing-and-lift line 17 are progressively unwound from the pole until the unwinding is completed and the ball again traverses the batter strike zone in which it can again be struck by the batter to reverse its direction and commence a new cycle of operation. On such a return through the strike zone, the attitude of the suspending line, swing-and-lift line and branch line differ from that in which they are shown in FIG. 1 in that both suspending line 16 and swing-and-lift line 17 are drawn taut into substantially straight lines from their points of anchoring to the splice 43 while the branch line 18 is drawn by the ball 20 and sleeve 19 under centrifugal force into an attitude extending lengthwise and downwardly and outwardly from splice 43 with the position of ball 20 outward and higher than the position in which it is shown in FIG. 1. In the event the batter misses the ball 20 on its fully unwound pass through the strike zone, the ball continues on a path which results in a spiral-like movement which returns the ball to the strike zone on a path to the right of that on which the ball made its fully unwound pass shown in FIG. 4, due to interaction of the suspending and swing-and-lift lines 16,17 reengaging the upright pole 35.

When the batter strikes the ball as the ball progresses from the full line position 39 to the dashed line position 40 shown in FIG. 4, the ball's direction of flight is reversed, and from the dashed line position 40 it moves in a clockwise direction along the spiral line of flight through positions 39 and 41 shown in FIG. 4. In the first clockwise circuit of pole 35 by ball 20 from position 40, line 16 begins wrapping on pole 35 at a point spaced from arm 36, such as point 42 shown in FIG. 1. When the batted ball is moving progressively closer to the pole 35 due to lines 16 and 17 progressively wrapping on pole 35, its rate of circling the pole 35 increases, the speed of revolution of the ball about the pole increases much like an ice skater spins with increasing rapidity when the skater, having commenced the spin with arms and possibly a leg extending horizontally outward, draws the limbs in close to the body. Such effect on the ball due to the fact that the ball is progressively radially closer to the pole and moves more rapidly, enhances the rebound of the ball following impact with the pole. The rebounding ball upon its return to the batter follows a descending path upon which movement is also aided by gravity forces acting on the ball.

While the use of the device depicted in FIG. 4 of the drawings illustrates use of the device by a right-handed batter, it is just as readily used by a left-handed batter who simply faces in a direction substantially opposite to that of the right-handed batter, and thus bats the ball to move counterclockwise about the pole as illustrated in FIG. 4 so the ball after rebounding from the pole 35 follows a clockwise return path.

The batter operated baseball batting practice device illustrated in the drawings and described above is presently considered to be the preferred embodiment of our invention, but is subject to structural modification without departing from the spirit and scope of the appended claims.

Having described our invention, what we claim as new and desire to secure by Letters Patent is:

1. A baseball batting practice device which comprises an upright support member and an overhead support member extending laterally from the upright support member, a ball having a diametral opening extending therethrough, a ball suspending line secured adjacent its upper end to said overhead support member, the ball suspending line extending through said opening in said ball, said suspending line having ball retaining means below the ball, the ball engaging the retaining means, a swing-and-lift line having one of its ends attached to the suspending line above the ball and slidably attached at its other end to the upright support below the level of the ball whereby the ball is suspended to be struck by a bat to follow a generally spiral path about the upright support as the lines are wound about the upright support member until the ball strikes and rebounds from said support and substantially retraces the spiral path back toward the point of bat impact.

2. A baseball batting practice device as in claim 1 wherein the diametral opening in the ball is snugly lined by a hollow metal tube, the end portions of the tube being flared outwardly to respectively compressively engage the surface of the ball adjacent the opening, the suspending line extending through the hollow of the tube, and the flared lower end portion of the tube engaging the ball retaining means.

3. A baseball batting practice device as in claim 2 wherein the upright support member is a pole about which the lines may wrap and unwrap.

4. A baseball batting practice device as in claim 3 wherein the lines are hollow braided polypropylene rope.

5. A baseball batting practice device as in claim 3 wherein the ball retaining means is a knot in the ball suspending line.

6. A baseball batting practice device as in claim 1 wherein the upright support member is a pole about which the lines may wrap and unwrap.

7. A baseball batting practice device as in claim 1 wherein the lines are hollow braided polypropylene rope.

8. A baseball batting practice device as in claim 1 wherein the ball retaining means is a knot in the ball suspending line.

9. A baseball batting practice device as in claim 1 wherein the diametral opening in the baseball is snugly lined by a hollow metal tube, the end portions of the tube being flared outwardly to overline in compressive engagement respective portions of the convex surface of the ball adjacent respective ends of the opening for compressively supporting the ball against elongation along the diameter of the ball coincided with the axial centerline of the opening and supporting the tube in the opening in the ball against distortion in a direction substantially radially of the opening, the suspending line extending through the hollow of the tube and the flared lower end portion of the tube engaging the ball retaining means.

10. A baseball batting practice device which comprises an upright support member and an overhead support means extending laterally from the upright support means, a suspension line secured to and depending from the overhead support means, a ball having a diametral opening extending therethrough and snugly lined by a metal tube, the end portions of the tube being flared outwardly to respectively compressively engage the subjacent surface of the ball, a ball suspending line secured adjacent its upper end to said overhead support means, the ball suspending line extending through said metal tube, a ball retaining knot in the suspending line below the metal tube, the lower end portion of the metal tube engaging the knot, a swing-and-lift line secured at one of its ends to the suspending line above the ball and slidably attached at its other end to the upright support below the level of the ball whereby the ball is suspended to be struck by a bat to follow a generally spiral path toward the upright support until it impacts with said support and substantially retraces the spiral path back to the point of bat impact.

11. A baseball batting practice device which comprises an upright support means and an overhead support means extending laterally from the upright support means, a ball having a diametral opening extending therethrough and snugly lined by a hollow metal tube, the end portions of the tube being flared outwardly to overlie in compressive engagement respective portions of the convex surface of the ball adjacent respective ends of the opening for compressively supporting the ball against elongation along the axial centerline of the opening and supporting the tube in opening in the ball against distortion in a direction substantially radially of the opening, a ball suspending line secured adjacent its upper end to said overhead support means, the ball suspending line extending through said hollow metal tube, a ball retaining knot in the suspending line below the metal tube, the flared lower end portion of the metal tube engaging the knot, a swing-and-lift line adjacent one of its ends to the suspending line above the ball and adjacent its other end to the upright support below the level of the ball whereby the ball is suspended to be struck by a bat to follow a generally spiral path toward the upright support until it impacts with said support and substantially retraces the spiral path back to the point of bat impact.

* * * * *